US005466654A

United States Patent [19]

Akutsu et al.

[11] Patent Number: 5,466,654

[45] Date of Patent: Nov. 14, 1995

[54] ERASABLE DISPLAY MEDIUM

[75] Inventors: Eiichi Akutsu; Hiroh Soga; Shigehito Ando; Susumu Hirakata; Kazuo Maruyama, all of Kanagawa, Japan

[73] Assignee: Fuji Xerox Co., Ltd., Tokyo, Japan

[21] Appl. No.: 284,999

[22] Filed: Aug. 3, 1994

Related U.S. Application Data

[63] Continuation of Ser. No. 995,336, Dec. 23, 1992, abandoned.

[30] Foreign Application Priority Data

Dec. 24, 1991 [JP] Japan ..... 3-355579

[51] Int. Cl.[6] ..... B41M 5/40

[52] U.S. Cl. ..... 503/206; 503/201; 503/207; 503/226

[58] Field of Search ..... 427/152; 503/201, 503/217, 225, 214, 206, 207, 226

[56] References Cited

U.S. PATENT DOCUMENTS 5,157,011 10/1992 Okabe et al. ..... 503/201
5,158,926 10/1992 Hotta et al. ..... 503/200

FOREIGN PATENT DOCUMENTS 429010 5/1991 European Pat. Off. ..... 503/200
2-258287 10/1990 Japan .

*Primary Examiner*—B. Hamilton Hess
*Attorney, Agent, or Firm*—Finnegan, Henderson, Farabow, Garrett & Dunner

[57] ABSTRACT

A display medium is disclosed, comprising at least the following layers, in this order: a heating resistive layer, a conductive layer, a background layer and an erasable thermochromic layer, and comprising a heating resistive layer which may comprise at least two layers. The display medium may also comprise a contact resistance reducing layer on the heating resistive layer and a protective layer on the erasable thermochromic layer.

16 Claims, 5 Drawing Sheets

ERASABLE DISPLAY MEDIUM

This application is a continuation, of application Ser. No. 07/995,336, filed Dec. 23, 1992, now abandoned.

FIELD OF THE INVENTION

This invention relates to a display medium capable of being written and erased.

BACKGROUND OF THE INVENTION

Conventionally, various proposals have been made for an erasable heat-sensitive recording material having a heat-sensitive recording layer whose transparency depends on temperature. For example, the fourth non-impact printing technology symposium theses and Japanese unexamined patent publication Hei 2-258287 (1990) describe a material having an erasable heat-sensitive recording layer, which is formed on a support and has an organic substance of low molecular weight, dispersed in a binding resin, to which writing and erasing are carried out thermally using a thermal head.

A conventional erasable heat-sensitive recording material, however, requires a high printing energy, and the printing characteristics of a thermal head which emits energy corresponding to the heat-sensitive recording layer are unsatisfactory, resulting in a very short thermal head life, requiring a long pulse input for printing or entailing a much-reduced printing speed. Attempts have been made to improve printing characteristics by reducing the film thickness of the heat-sensitive recording layer, increasing the amount of organic substance of low molecular weight dispersed in the binder resin. In this case again, the optical contrast of the image and background portion and the repeatability decline, and an image of high resolution cannot be obtained, because of the high thermal diffusion caused by the image input using a thermal head.

SUMMARY OF THE INVENTION

It is an object of the present invention to provide an erasable heat-sensitive recording material free of the defects found in the conventional art.

It is another obejct of the present invention to provide a display medium capable or being printed and erased with a small printing energy.

It is a further object of the present invention to provide a display medium having a high optical contract of image and background portions.

It is a further object of the present invention to provide a display medium capable of providing an image of high resolution having high image durability.

It is yet further object of the present invention to provide a display medium allowing supplementary overwriting.

Additional objects and advantages of the invention will be set forth in part in the description which follows and in part will be apparent to a person with ordinary skill in the art from the description, or may be learned by practice of the invention.

This invention relates to a display medium comprising at least the following layers, in this order: a heating resistive layer, a conductive layer, a background layer and an erasable thermochromic layer.

This invention relates to a display medium whose heating resistive layer may comprise at least two layers.

This invention relates to a display medium which may have a contact resistance reducing layer on a heating resistive layer and a protective layer on an erasable thermochromic layer.

BRIEF DESCRIPTION OF THE DRAWINGS

The manner by which the above objects and other objects, features and advantages of the present invention are attained will be fully evident from the following detailed description when it is considered in light of the accompanying drawings, wherein.

DETAILED DESCRIPTION OF THE INVENTION

Figure 1:
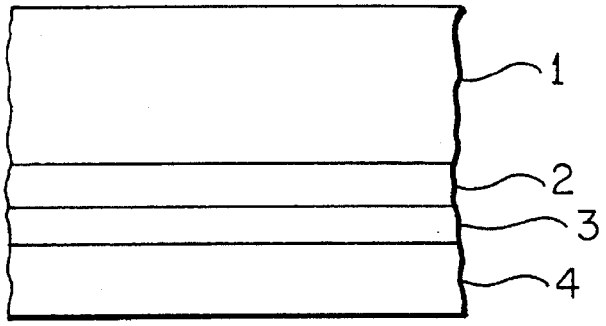
FIG. 1 is a diagrammatical view of an example of a display medium of this invention.
Figure 2:
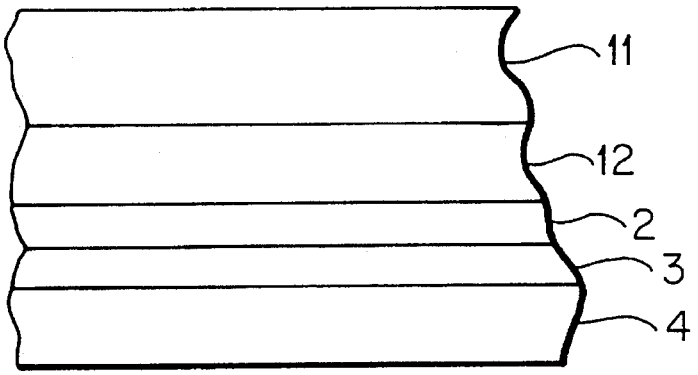
FIG. 2 is a diagrammatical view of another example of a display medium of this invention.
Figure 3:
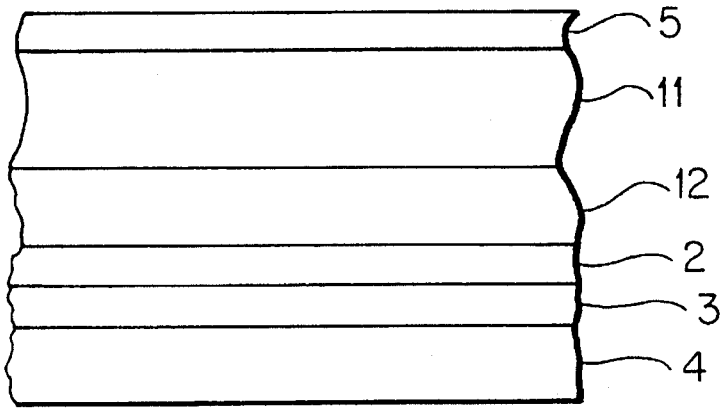
FIG. 3 is a diagrammatical view of a further example of a display medium of this invention.
Figure 4:
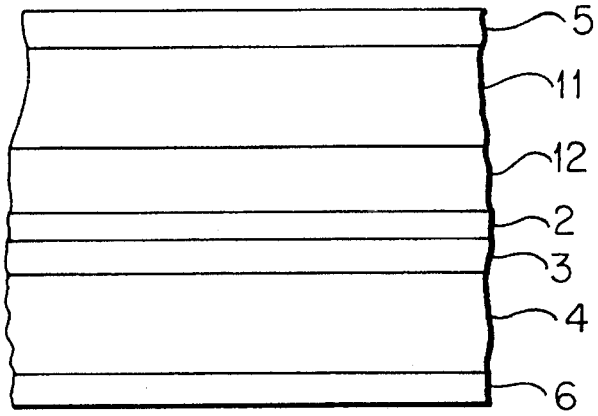
FIG. 4 is a diagrammatical view of yet another example of a display medium of this invention.

FIGS. 1 to 4 inclusive are cross-sectional views of embodiments of a display medium of this invention. In these figures, 1 is a heating resistive layer, 2 is a conductive layer, 3 is a background layer, 4 is an erasable thermochromic layer, 5 is a contact resistance reducing layer and 6 is a protective layer. In FIG. 1, the heating resistive layer has a single-layer structure, and in FIGS. 2 to 4 inclusive, the heating resistive layer has a two-layer structure comprising a first heating resistive layer 11 and a second heating resistive layer 12.

Each portion of the display medium of this invention is now described. A heating resistive layer may have a single-layer structure or comprise at least two layers, and the following description is mainly based on one having a two-layer structure.

The first heating resistive layer does not act as a main heating portion but as a current path for signal current and as a support, so a material having a volume resistivity from $10^{-3}$ Ω.cm to $10^{4}$ Ω·cm, more preferably from $10^{-1}$ Ω·cm to $10^{2}$ Ω·cm and a thickness from 0.5 μm to 200 μm, more preferably from 3 μm to 50 μm is used for the layer. It is preferable that the heat-resistance, the temperature up to which the geometric deformation of the first heating resistive layer is not excessive, by which is meant a deformation exceeding 20 percent, is at least 150° C. and preferably at least 250° C.

In the first heating resistive layer, at least one resin selected from a polyimide resin, an aromatic polyamide resin, a polysulfone resin, a polyimide amide resin, a polyester-imide resin, a polyphenylene oxide resin, a poly-p-xylylene resin, a polybenzimidazole resin or a derivative thereof can be used as a binding component, and conductive resins such as conductive carbon particles, very fine metal, conductive ceramic powder, polyaniline and the like, or an ion type conductive material such as charge transfer complex binder type photosensitive layer or the like are used as conductive materials. One or more of the conductive materials is dispersed or dissolved in the binding component to form the first heating resistive layer.

A second heating resistive layer is the main heating portion, where the principal electrical-thermal energy conversion required for the display is carried out. The heating characteristics such as heating distribution, heating quantity and the like depends on the thickness and the resistive value of the second heating resistive layer, and such factors have a large effect on the display characteristics.

In this invention, the first and the second heating resistive layers are correlated, and good display characteristics are obtained when the correlation satisfies the condition expressed by $$1.2\,T_1-R_1 \leqq T_2-R_2 \quad (1)$$

$$R_2>R_1 \quad (2)$$

In (1) and (2), $T_1$ indicates the thickness of the first heating resistive layer, $R_1$ indicates the volume resistivity of the first heating resistive layer, $T_2$ indicates the thickness of the second heating resistive layer and $R_2$ indicates the volume resistivity of the second heating resistive layer.

When inequalities (1) and (2) do not hold, the first heating resistive layer has a higher temperature than the second heating resistive layer, and this fact brings about not only a decline of display energy efficiency but also more damage in the contact portion of the recording head, instability of the repeating durability and display characteristics and a decline of resolution caused by thermal diffusion.

It is preferable that the second heating resistive layer has a volume resistivity from $10^{-1}$ to $10^{6}$ Ω·cm, more preferably from $10^{0}$ to $10^{4}$ Ω·cm, a thickness from 50 nm to 20 μm, more preferably from 0.2 to 4.7 μm and is heat-resistant up to at least 250° C.

The material forming the second heating resistive layer may be a single ceramic, a mixture or a complex of ceramics, a material comprising one or more kinds of conductive filler and dielectric filler or a mixture thereof in a heat-resistant resin, or a mixture or a compound of ceramics and metallic materials. For example, as a conductive filler and a conductive material, alloys comprising one or more of carbon, nickel, gold, silver, iron, zinc, aluminum, titanium, tantalum, palladium, copper, cobalt, chrome, platinum, molybdenum, ruthenium, rhodium, vanadium, niobium, tungsten, indium or the like, or vanadium dioxide, ruthenium oxide, tantalum nitride, silicon carbide, zirconium dioxide, tantalum nitride, zirconium nitride, niobium nitride, vanadium nitride, titanium diboron, zirconium diboron, hafnium diboron, tantalum diboron, molybdenum diboron, chrome diboron, boron carbide, moribdenum boron, zirconium carbide, vanadium carbide, titanium carbide or the like may be used.

As a dielectric material for binding the conductive material or reducing the resistance of the entire layer, ceramics such as aluminum nitride, silicon nitride, aluminum oxide, magnesium oxide, vanadium dioxide, silicon dioxide, zirconium dioxide, molybdenum dioxide, bismuth oxide, titanium dioxide, molybdenum dioxide, tungsten dioxide, niobium dioxide, boron hexaoxide, rhenium trioxide, silicon nitride or the like and heat-resistive resins set forth for the first heating resistive layer may be used.

Figure 5A:
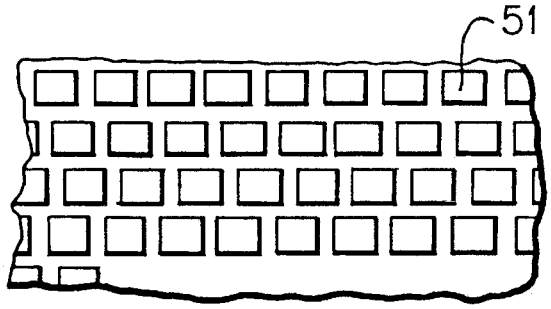
FIG. 5 is a plan view and a cross-sectional view of an example of a contact resistance reducing layer.
Figure 5B:
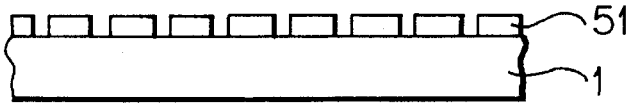
Figure 6:
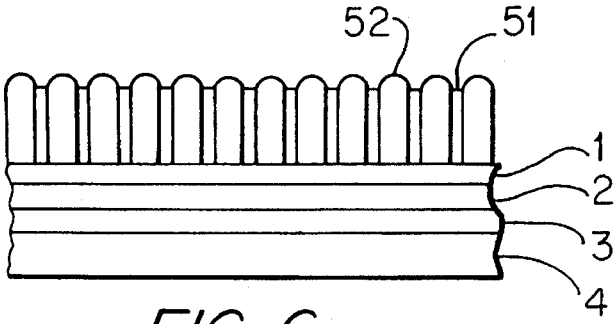
FIG. 6 is a diagrammatical view of another example of a contact resistance reducing layer.

A contact resistance reducing layer may be formed on the heating resistive layer surface. A conductive pattern in the contact resistance reducing layer may be formed of, for example, a conductive paste having silver particles dispersed therein. FIG. 5 shows an example in which a conductive pattern 51 is formed on the heating resistive layer surface. The contact resistance reducing layer may be a layer made up of a dielectric substance 52 such as a resin and a conductive pattern 51 as shown in FIG. 6.

A conductive layer acts as a return conductive path which diffuses the current entering the heating resistive layer, and it comprises a good conductive material such as a metal or conductive ceramic which has a volume resistivity of not more than $10^{-2}$ Ω·cm.

For preparing the conductive layer, a vacuum deposition process, a sputtering process, a coating process or an ion plating process may be applied. The thickness of the conductive layer is from 50 nm to 5 μm, and more preferably from 100 nm to 500 nm. If the thickness is more than 5 μm, thermal diffusion and thermal leakage from the conductive layer tends to occur, which leads to a decline of the characteristics. If the thickness is less than 50 nm, the conductive characteristics of the current path decline, the current-carrying durability declines and the return path resistance increases, which leads to a lower energy efficiency and similar problems.

The background layer makes the portions where the thermochromic material has become transparent generate color corresponding to the printing images, and comprises a coloring material having a heat resistance or a metallic material, it may be unified with the conductive layer. For example, a resin layer having carbon black dispersed therein, a sublimated carbon black layer, a resin layer having a metal containing pigment dispersed therein or a sublimated metal containing pigment layer can be used as a background layer.

Figure 7:
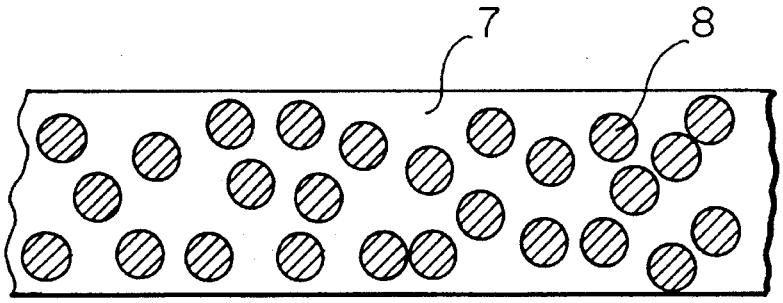
FIG. 7 is a diagrammatical view of an erasable photochromic layer.

An erasable thermochromic layer is formed by dispersing an organic material of a comparatively low molecular weight having a particle diameter from 0.2 μm to 5 μm uniformly in a macro-molecular matrix material. A phase transition of the organic material and the macro-molecular matrix occurs by heating, which changes the optical index of refraction, and makes the material transparent or opaque corresponding to the heating characteristics thus forming an image. FIG. 7 is a cross-sectional view of a thermochromic layer, in which an organic material 8 is dispersed in a macro-molecular matrix material 7.

Known organic materials such as straight chain hydrocarbons, straight chain halogenized hydrocarbons, straight chain saturated or unsaturated aliphatic carboxylic acids, esters and amides of straight chain saturated or unsaturated aliphatic carboxylic acid, aliphatic thioalcohols, halogenized aliphatic acids, a fatty acid thioalcohol ester, saturated or unsaturated aliphatic alcohols, a phenyl group containing unsaturated hydrocarbons and the like can be used for dispersion in the macro-molecular matrix material 7. Of these organic materials, those having from 35 to 600, more preferably from 72 to 300 carbon atoms in the straight chain show good characteristics. If the number of carbon atoms is less than 35, the heat-resistance declines, which brings about decomposition, gasification and unstable characteristics. If the number of carbon atoms is more than 600, the viscosity at dispersion processing is too high for the particles to be dispersed properly.

As the macro-molecular matrix material, can be used a silicon type resin, a polyimide resin, a polyester resin, a polyimideamide resin, an aromatic polyamide resin, a polysulfone resin, a polyxylylene resin, a polystyrene resin, an acryl type resin, a polycarbonate resin or the like, and of these, those having molecular weights in the range 5000 to 100,000, more preferably in the range 25,000 to 50,000 are preferable.

It is preferable that the weight ratio of the macro-molecular matrix material to the organic material of low molecular weight is from 2:1 to 30:1, and from 3:1 to 5:1 more preferably.

A protective layer may be formed on the erasable thermochromic layer surface. As a material forming a protective layer, a silicon type resin and a fluorine containing type resin are preferable for providing good characteristics. It is preferable to mix a silicon type substance of low molecular weight or powder of a fluorine containing type resin in the protective layer to improve the critical surface energy. It is preferable that the amount of these powders is not more than 20 percent by weight, more preferably from 1 percent to 10 percent by weight.

A good critical surface energy of a protective layer is not more than 30 dyne/cm, more preferably not more than 22 dyne/cm. If it is more than 30 dyne/cm, dirt attaches easily and is not easily removed, and the friction coefficient of the protective layer and an electrode portion of the printing head contacted under pressure is high, which allows scratching and abrasion tend to occur.

It is preferable that the thickness of a protective layer is from 0.1 μm to 20 μm, more preferably from 0.3 μm to 2 μm. If the thickness is less than 0.1 μm, it does not function well as a protective layer, and scratching and defects in the image forming layer tend to occur in repeated use. If the thickness is more than 20 μm, the optical contrast and image resolution tend to decline.

In this invention, a protective layer may act as a support. In this case, a material having a thickness from 40 μm to 50 μm and a transparency of at least 15 percent in the visible light area can be used as a rigid support. For example, glass, acrylic resin, polyester resin or the like can be used. When a rigid support is used, the thickness of the heating layer, conductive layer, display layer and contact resistance reducing layer can be reduced, which leads to improved printing efficiency and image quality.

Figure 10:
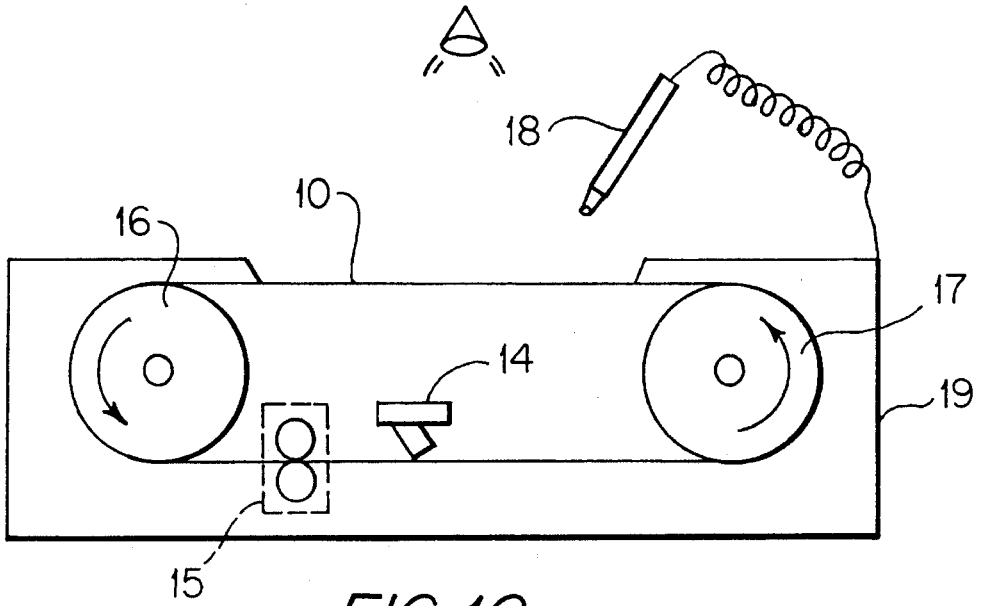
FIG. 10 is a schematic illustration of a display device using a display medium of this invention.
Figure 11:
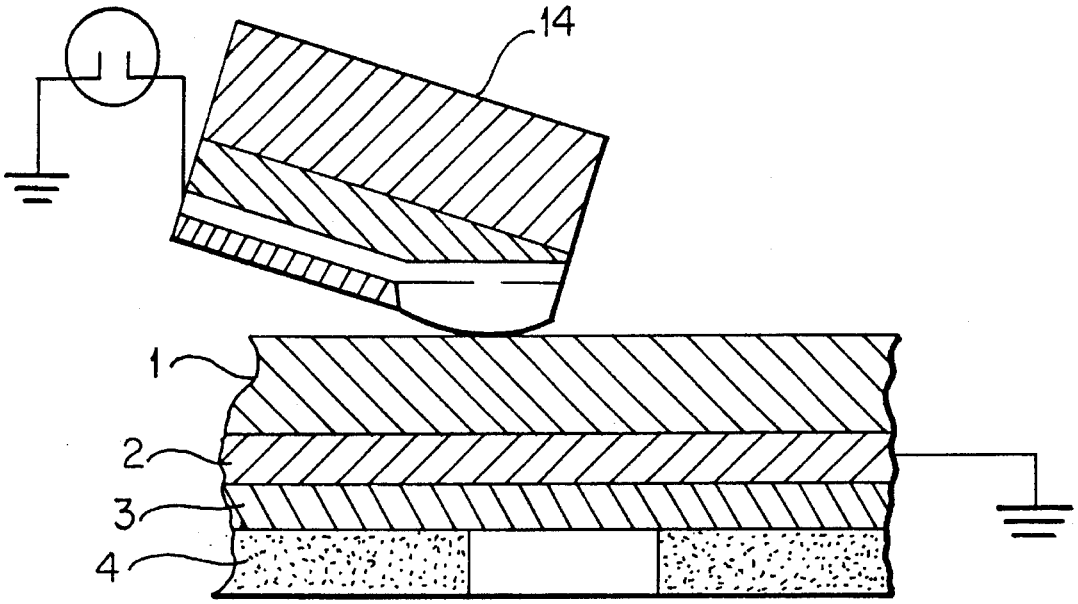
FIG. 11 is a cross-sectional view of the main portion of FIG. 10.
Figure 12:
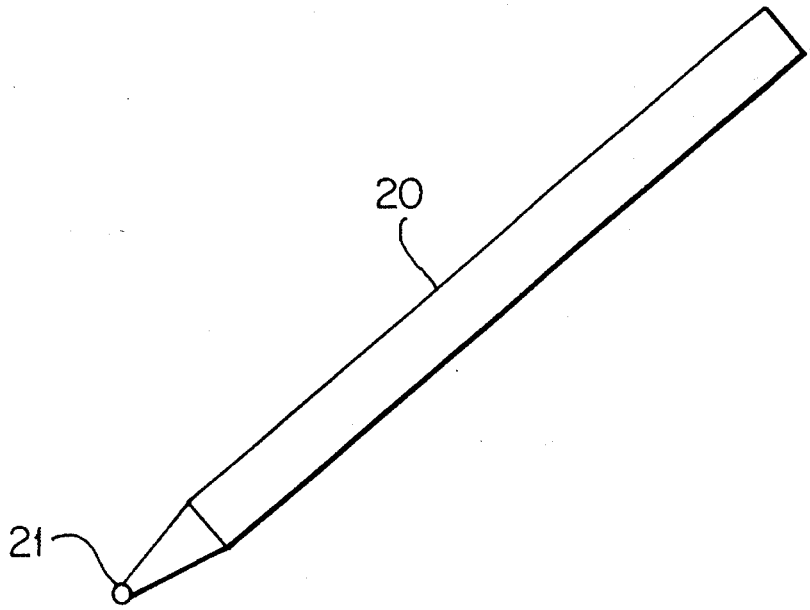
FIG. 12 is a schematic of a thermal pen.

A display device using the display medium of this invention is now described. FIG. 10 is a schematic illustration of the display device, FIG. 11 is an enlarged view of the main portions of it and FIG. 12 is a schematic of a thermal pen. In FIG. 10, 10 is a display medium in the shape of a belt and it is rotatably supported by transport rollers 16 and 17 provided in a cabinet 19.

In the display device, a printing head 14 and a an image erasing unit 15 are provided, and a thermal pen for supplementary writing is also provided. The display medium comprises a heating resistive layer 1, a conductive layer 2, a background layer 3 and an erasable thermochromic layer 4, and the thermal pen has a thermal point 21 at the tip of a body 20.

For printing using the display medium, a contact type printing head, to which an image signal is input, comprises very small electrodes which correspond to pixels and contacts under pressure the surface of the belt, facing the heating resistive layer. The printing head scans the display medium, and a current corresponding to the image signal is passed through the heating resistive layer through the electrodes of the printing head. If there is a contact resistance reducing layer on the heating resistive layer surface, the layer decreases the resistance value of dynamic contact, which makes the current run in the thickness direction of the contact resistance reducing layer. The current is converted to thermal energy in the heating resistive layer, the signal current providing the heating passes into the conductive layer and is diffused in the direction orthogonal to the thickness direction with the energy loss being minimized and goes to a ground portion or a specified return path portion. The thermal energy generated in the heating resistive layer passes in the thickness direction to the conductive layer and the background layer, and it thus reaches the erasable thermochromic layer. In the erasable thermochromic layer, a thermal change occurs in the image corresponding to the image signal being input, and the image is developed by the medium becoming opaque or transparent.

The above described printing may also be carried out by writing with a pen having a thermal point.

In order to return the whole erasable display medium to its original state, and thus erase the image, either the entire display medium on which the image is formed is heated to a certain temperature higher than the temperature required for forming the image, or alternatively a larger current than is input to form the image is input to the whole area of the display medium so as to heat the erasable thermochromic layer to a certain temperature.

Figure 8:
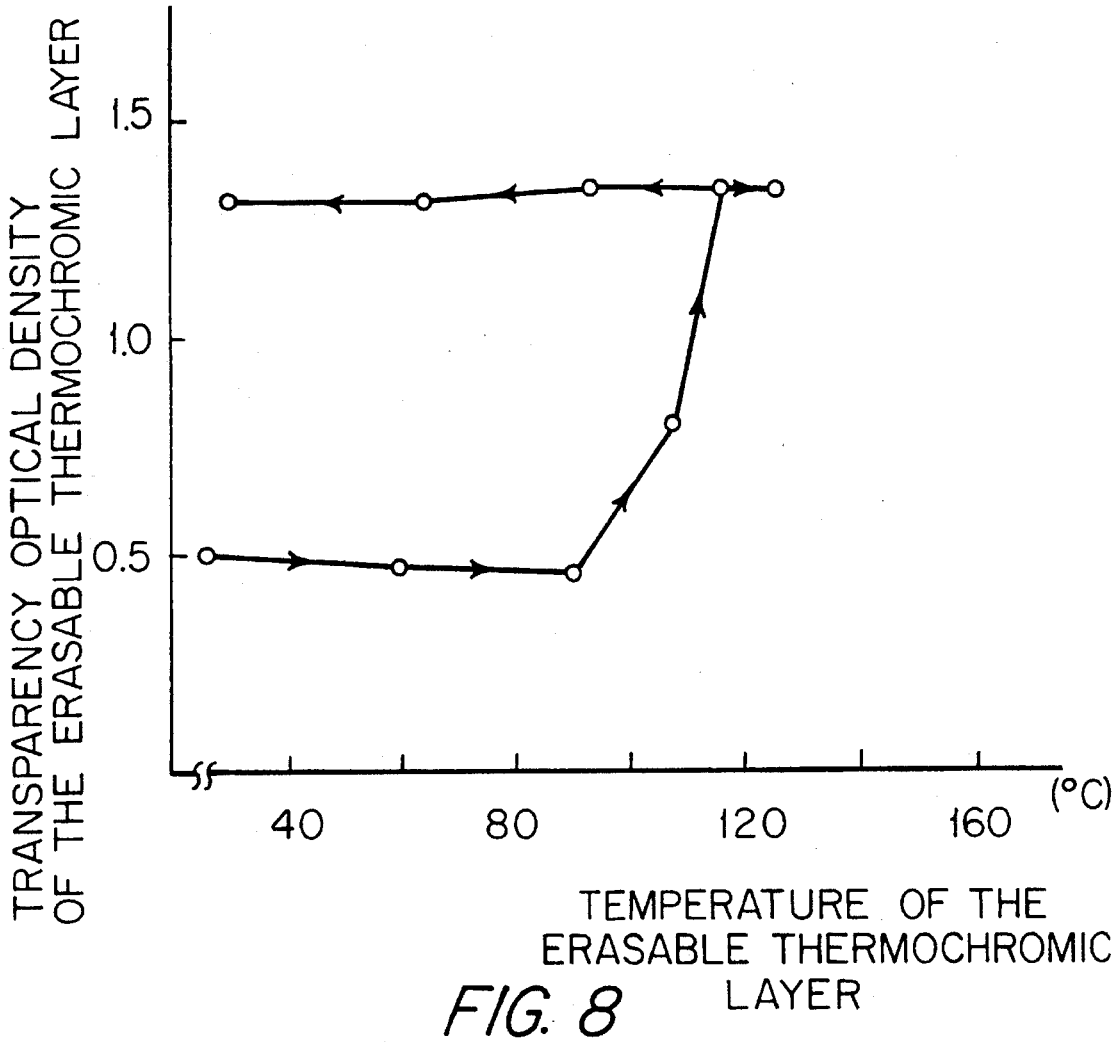
FIG. 8 is a graph showing temperature characteristics of an example of a display medium of this invention.
Figure 9:
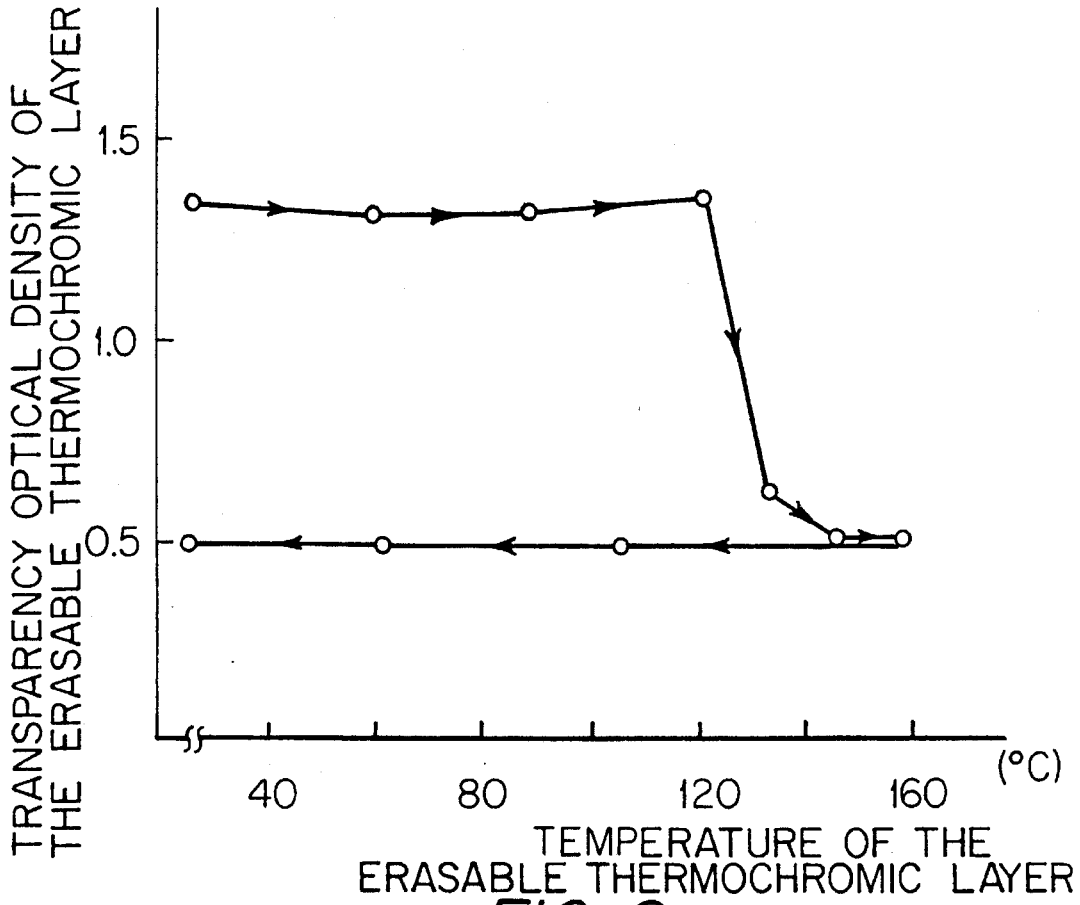
FIG. 9 is a graph showing temperature characteristics of another example of a display medium of this invention.

FIG. 8 shows temperature characteristics for forming an opaque image in a transparent display medium, and FIG. 9 shows temperature characteristics for forming a transparent image in an opaque display medium.

Repeated image display is carried out by repeating above described writing process and erasing process.

EMBODIMENT 1

A two-layer-structure heating resistive film was prepared by forming on a first heating resistive layer comprising a polyimide film having carbon particles dispersed therein, with a thickness of 30 μm and a volume resistivity of 1.0 Ω·cm a second heating resistive layer having carbon particles dispersed therein, with a thickness of 2 μm and a volume resistivity of 7.0 Ω·cm.

Next, nickel having a film thickness of 300 nm was vacuum deposited on the second heating resistive layer at a substrate temperature of 150° C. and a vacuum of $2\times10^{-6}$ Torr. Next, carbon black was vacuum deposited on the nickel-covered film surface under the same conditions as the nickel deposition process to form a background layer having a film thickness of 100 nm.

A dispersed solution was prepared by blending at a weight ratio of 4:1 a solution made by dissolving a polyester resin having an average molecular weight of 10,000 approximately in toluene and having a solid content of 20% by weight, with a solution made by dissolving an amide type resin having a molecular weight of 500 approximately in methanol and having a solid content of 10% by weight, and then by forcibly mixing them using a homogenizer. A display medium was obtained by applying the obtained dispersed solution to the above described background layer surface and drying it at 120° C. for 10 minutes, thus forming an erasable thermochromic layer having a thickness of 12 μm.

A printing head having a width of 300 mm and image writing elements which are 40 μm square of tungsten projecting by 30 μm and aligned with a pitch of 62.5 μm was brought into contact under pressure with the polyimide film forming the first heating resistive layer of the display medium. A pulse signal was input from the head to the heating resistive layer by a pulse drive with a pulse width of 500 μs and a voltage of 12 V, and the head was made to move relative to the display medium at a linear speed of 60 mm/s. The thermochromic layer was made opaque and the image was developed corresponding to the input signal. The optical reflection density of the image was 0.40 and that of the background portion was 1.60 at this point.

Next, as an erasing process, the optical reflection density of the entire surface of the display medium was made to be 0.40±0.1 by applying a pulse drive to the display medium with a pulse length of 650 μs and a voltage of 16 V, thus heating the entire surface of the heat-sensitive resistive layer. After repeating the displaying and erasing process 100 times, the optical reflection density was 0.50±0.1 after erasing.

EMBODIMENT 2

A contact resistance reducing layer was formed on the first heating resistive layer of the two-layer-structure heating resistive film prepared in embodiment 1. A pattern of areas with a pitch of 31 μm, a 20 μm square and a thickness of 8 μm was made on the entire surface of the first heating resistive layer by a photolithographic process and lift off process, using a conductive paste having silver particles having a volume resistivity of $2\times10^{-2}$ Ω·cm dispersed therein.

Next, aluminum was deposited by an electron beam heating vacuum deposition process to form a film having a thickness of 200 nm on the rear side of the heating resistive film where the contact resistance reducing layer had been formed, in another words, on the second heating resistive layer at a substrate temperature of 110° C. and a vacuum of $2\times10^{-6}$ Torr. Next, copper phthalocyanine was vacuum deposited on the aluminum film surface under the same conditions as the aluminum deposition process to form a background layer having a film thickness of 400 nm.

An emulsion was prepared by blending at a weight ratio of 5:1 a solution made by dissolving a styrene resin having an average molecular weight of 500 approximately in xylene and having a solid content of 30% by weight, with a solution made by dissolving a polyvinyl alcohol having a molecular weight of 220 approximately in methanol and having a solid content of 30% by weight and then forcibly by mixing them using a homogenizer. A display medium was obtained by applying the obtained emulsion to the above described background layer surface by a roll coating process and drying it at 120° C. for 20 minutes, thus forming an erasable thermochromic layer having a thickness of 7 μm.

A printing head having a width of 300 mm and image writing elements which are 40 μm square of tungsten projecting by 30 μm and aligned with a pitch of 62.5 μm was brought into contact under pressure with the contact resistance reducing layer of the above described display medium. An image signal was input from the image writing element of the head to the contact resistance reducing layer by a pulse drive at a pulse width of 400 μs and a voltage of 2 V, and the head was made to be carried on the display medium at a linear speed of 60 mm/s. The thermochromic layer was made opaque and the image was developed corresponding to an input image signal. The cyan optical reflection density of the image was 0.61 and that of the background portion was 1.46 at this point.

Next, as an erasing process, the display medium was heated to 130° C. by a heating roller, to erase the recorded image. The cyan optical reflection density of the display medium was 0.62 at this point. The cyan optical reflection density of the image was 1.39 and that of the background portion was 0.65 after repeating the displaying and erasing process 500 times.

EMBODIMENT 3

The same display medium as embodiment 2 was prepared, and a fluorine containing silicon resin was applied to the thermochromic layer side of this display medium to form a protective layer having a thickness of 0.5 μm. The critical surface tension of this protective layer was 18 dyne/cm. It was possible to write a character to the protective layer of this display medium by contacting a thermal pen having a point whose tip was heated to 140° C. and sliding it by hand.

EMBODIMENT 4

A thermochromic layer having a thickness of 10 μm was formed on a blue glass substrate having a thickness of 10 mm in the same way as embodiment 2. Next, a background layer having a thickness of 1.5 μm was obtained by applying an aqueous emulsion of a polyester resin toluene solution containing a phthalocyanine pigment and drying it, and then, by depositing aluminum on this background layer surface by a vacuum deposition process, a conductive layer having a thickness of 200 nm was obtained. Next, a dispersed type heating resistive layer comprising silicon dioxide and tantalum having a volume resistivity of 8×10 Ω·cm and a thickness of 1.5 μm was formed by applying a hybrid sputtering process to the two constituents. A pulse signal was applied to the heating resistive layer surface with a pulse width of 1.5 ms, a pulse period of 3.0 ms and an applied voltage of 5 V, using the display medium of this embodiment and the printing head described in embodiment 2. The moving speed of the printing head was 22 m/s, and a white image of good quality was obtained in the blue background.

What is claimed is:

1. An erasable display medium for displaying images in response to a signal current, comprising:

a heating resistive layer having a first layer as a current path area for said signal current and a second layer as a converting area for converting said signal current into thermal energy;

a conductive layer formed on said second layer of said heating resistive layer, said conductive layer comprising a current returning portion for returning said signal current to a ground portion; and an erasable thermochromic layer comprising a low molecular weight organic material having particles dispersed in a macro-molecular matrix material, wherein said erasable thermochromic layer is formed on said conductive layer for forming an image having an opaque portion and a transparent portion by said thermal energy being passed through said conductive layer.

2. The erasable display medium of claim 1, further comprising a background layer formed between the conductive layer and the erasable thermochromic layer, said background layer having a coloring material dispersed therein and generating a color corresponding to said transparent image.

3. The display medium of claim 2 wherein said background layer has carbon black dispersed therein.

4. The display medium of claim 1 whose heating resistive layer comprises at least two layers.

5. The display medium of claim 1 having a patterned contact resistance reducing layer on the heating resistance layer, said patterned contact resistance reducing layer comprising a dielectric resin and conducting particles.

6. The display medium of claim 1 allowing overwriting by a writing tool having a thermal point.

7. The display medium of claim 1 having a protective layer on the erasable thermochromic layer.

8. The display medium of claim 7, in which said protective layer has a thickness from 40 μm to 50 μm and a transparency in the visible light area of at least 15 percent, and functions as a support.

9. The display medium of claim 7 in which said protective layer has a thickness from 0.1 μm to 20 μm and a critical surface tension of not more than 30 dyne/cm.

10. A display medium of claim 1, wherein said first layer of said heating resistive layer comprises at least one conductive material dispersed in a binding component.

11. A display medium of claim 10, wherein said first layer of said heating resistive layer has a volume resistivity between $10^{-3}$ Ωcm and $10^{4}$ Ωcm, a thickness between 0.5 μm and 200 μm, and a heat resistance of at least 105° C.

12. A display medium of claim 1, wherein said second layer of said heating resistive layer comprises one of a ceramic, a mixture of ceramics, a mixture of conductive filler and dielectric filler in heat resistant resin, and a mixture of ceramics and metallic materials.

13. A display medium of claim 12, wherein said second layer of said heating resistive layer has a volume resistivity between $10^{-1}$ Ωcm and $10^{8}$ Ωcm, a thickness between 50 nm and 20 μm, and a heat resistance of at least 250° C.

14. A display medium of claim 1, wherein said conductive layer comprises metal or conductive ceramic.

15. A display medium of claim 14, wherein said conductive layer has a volume resistivity of at least $10^{-2}$ Ωcm and a thickness between 50 nm and 5 μm.

16. A display medium of claim 1, wherein said organic material has between 35 and 600 carbon atoms in a straight chain and wherein said macro-molecular matrix material and said organic material have a weight ratio between 2:1 and 30:1.

* * * * *